United States Patent [19]

Izumi et al.

[11] 4,054,516

[45] Oct. 18, 1977

[54] METHOD FOR SELECTIVELY CAPTURING METAL IONS

[75] Inventors: Gaku Izumi; Makoto Sato, both of Sendai; Sakae Shoji, Tagajo, all of Japan

[73] Assignee: Director-General of the Agency of Industrial Science and Technology, Tokyo, Japan

[21] Appl. No.: 625,144

[22] Filed: Oct. 23, 1975

Related U.S. Application Data

[63] Continuation-in-part of Ser. No. 447,913, March 4, 1974, abandoned.

[51] Int. Cl.[2] ..... B03D 1/00

[52] U.S. Cl. ..... 210/44; 209/167; 423/26

[58] Field of Search ..... 210/38 B, 44, 54, 58; 209/166, 167; 252/180; 423/26

[56] References Cited

U.S. PATENT DOCUMENTS

| | | | |
|---|---|---|---|
| 3,054,746 | 9/1962 | Gaden et al. | 209/166 |
| 3,238,127 | 3/1966 | Sebba | 209/166 |
| 3,260,365 | 7/1966 | Dickson et al. | 209/166 |
| 3,459,649 | 8/1969 | Müller et al. | 209/166 |
| 3,476,553 | 11/1969 | Sebba et al. | 423/26 |
| 3,640,862 | 2/1972 | Gieseke et al. | 209/166 |
| 3,768,646 | 10/1973 | Grannen | 209/166 |
| 3,932,274 | 1/1976 | Izumi et al. | 210/44 |

*Primary Examiner*—Thomas G. Wyse
*Attorney, Agent, or Firm*—William J. Daniel

[57] ABSTRACT

A method for selectively capturing metal ions by treating a solution containing ions of heavy metals, such as cupric ions, zinc ions, etc., at an adjusted pH value with a metal capturing agent comprising a condensation product of a higher fatty acid or derivative thereof with an excess of a polyamine, for example, a condensation product of decanoic acid and a polyamine. Heavy metal ions contained in effluents from mines and factories are selectively captured and separated according to this method.

4 Claims, 7 Drawing Figures

RECOVERY RATE (%)
Zn
Cu
pH

RECOVERY RATE (%)
Zn
Pb
pH

RECOVERY RATE (%)
Zn
Cu
pH

RECOVERY RATE (%)
Zn
Pb
Cu
pH

RECOVERY RATE(%)
Mn
Ni
Cu
pH

RECOVERY RATE (%)
Mn
Co
Pb
Ni
Cu
pH

RECOVERY RATE (%)
Mn
Zn
pH

METHOD FOR SELECTIVELY CAPTURING METAL IONS

CROSS-REFERENCE TO RELATED APPLICATIONS

This application is a continuation-in-part of application Ser. No. 447,913, filed Mar. 4, 1974 now abandoned.

BACKGROUND OF THE INVENTION

This invention relates to a method for selectively capturing metal ions from a solution containing ions of heavy metals, and preferably at least two such metals.

Industrial effluents from metal mines and factories contain a variety of metal ions among which heavy metal ions are known to have an adverse influence on human and animal bodies and thus are desired to be removed completely before the effluents are actually discarded into rivers, lakes, oceans and other bodies of water. As ways for eliminating such metal ions, there have been proposed a method wherein industrial effluents are treated with a metal capturing agent such as a condensed phosphate or ethylenediaminetetraacetic acid and a method wherein industrial effluents are biologically treated with microorganisms. However, these methods are not as yet practically applicable for several disadvantageous reasons. Thus, in the first case, the metal capturing agent is too expensive for the treatment of large amounts of effluent and, in the second, a sufficient level of elimination is not achieved by the biological treatment. On the other hand, if a variety of metals contained in effluents could be recovered selectively and separately, it would be a significant advance in the art, particularly in respect to re-utilization of the recovered metals. However, there is up to now no known method for treating effluents which can serve this purpose.

BRIEF SUMMARY OF THE INVENTION

It is an object of this invention to provide a practical method for easily and effectively eliminating metal ions contained in effluents from mines and factories.

It is another object of this invention to provide a method for selectively separating and recovering a variety of metals contained in effluents from mines and factories.

Other objects, features and advantages of this invention will be apparent from the following description when read in conjunction with the accompanying drawings in which FIGS. 1 - 7 represent plots of the metal ion recovery rates, expressed as a percentage, against varying pH for various combinations of two or more types of metal ions, identified by appropriate chemical symbols, and illustrating the different threshold values at which substantial recovery for the respective metals takes place.

DETAILED DESCRIPTION OF THE INVENTION

Figures 1, 2, 3, 4, 5, 6, 7:
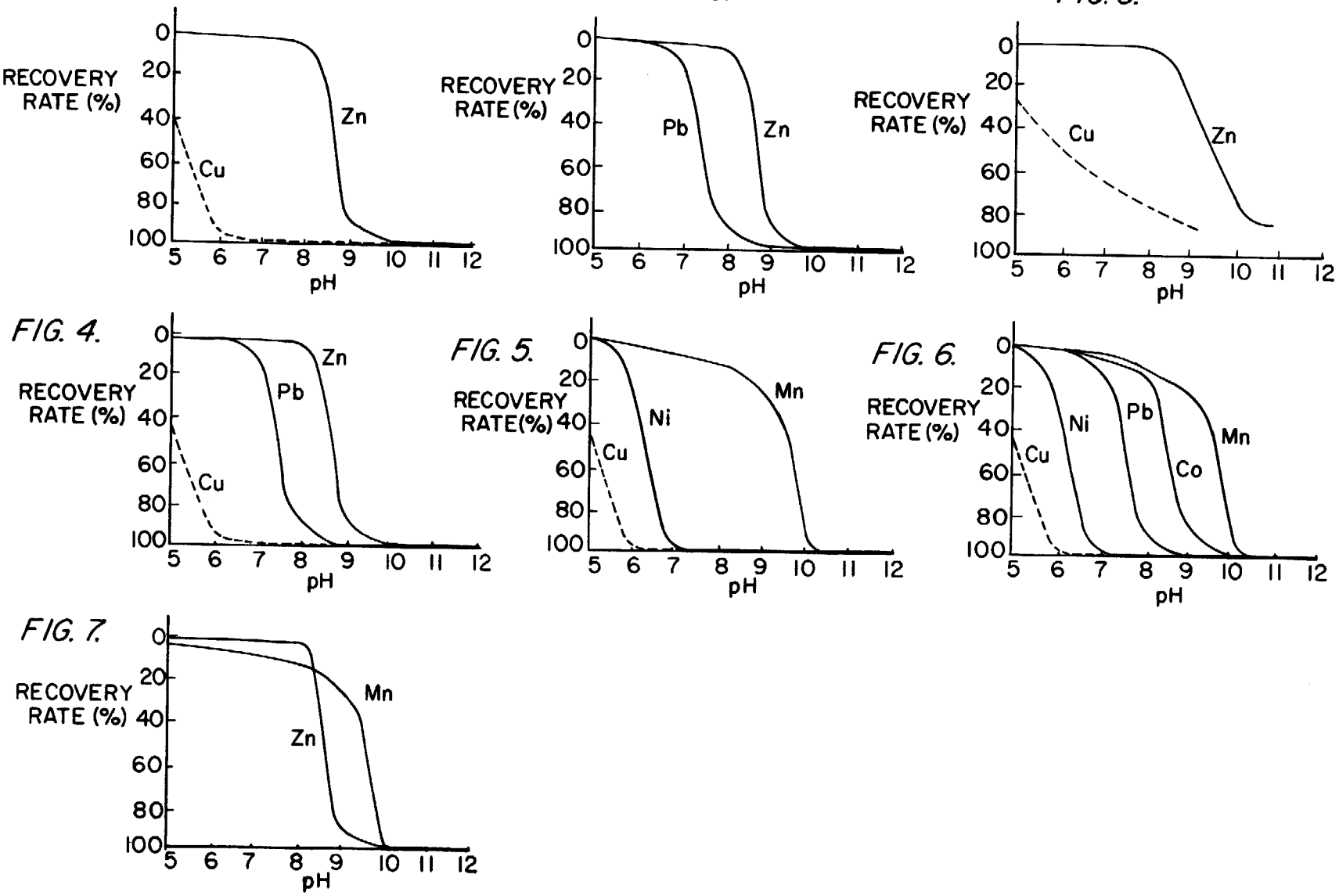

It has now been found that a condensation product of a higher fatty acid with an excess of a polyamine possesses extremely high adsorptivity for various metal ions and displays selective adsorptivity to particular metals when the pH condition is varied adequately.

In accordance with this invention, there is provided a method for selectively capturing metal ions which comprises treating, with adjustment of pH, a solution containing metal ions, and preferably at least two kinds of metal ions, with a metal ion capturing or complexing agent composed of a condensation product of a higher fatty acid with an excess of a polyamine.

The condensation product of a higher fatty acid and a polyamine used in the invention as a metal ion complexing agent is prepared by condensing a higher fatty acid, or a reactive functional derivative thereof, for example, an ester or halide of the higher fatty acid, with an excess molar amount of polyamine.

Higher fatty acids are commercially available as natural substances or petrochemical products. Especially preferable are those having at least about 8 carbon atoms. Examples of such higher fatty acids include octanoic acid, nonanoic acid, decanoic acid, 12-hydroxy-9-decenoic acid, dodecanoic acid, tetradecanoic acid, hexadecanoic acid, octadecanoic acid and eicosanoic acid as well as esters and acid halides of these acids. These compounds can be used alone or in mixtures of at least two. From the viewpoint of metal-capturing effect and ease in separation from the captured metals after use, a monomer having a molecular weight of at least 140 or a polycondensate is advantageously selected.

These monomers, polycondensates, and mixtures thereof can be used as starting material and reacted with a polyamine to prepare the desired metal ion adsorbents.

The polyamine of the invention is a compound having at least two amino groups in the molecule and represented by the general formula:

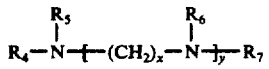

wherein $R_4$, $R_5$, $R_6$ and $R_7$ each represent a hydrogen atom or a hydrophobic group selected from an alkyl group, and an arylalkyl group, and $x$ and $y$ each represent an integer of at least 1. Examples of such compound include diamines where $x$ varies from about 1 to about 5, such as ethylenediamine, tetramethylenediamine and pentamethylenediamine, and polyalkylenepolyamines where $y$ varies from 1 to about 4, such as diethylenetriamine, triethylenetetramine and tetraethylenepentamine.

The condensation reaction is carried out by heating the above defined fatty acid ester and a monar excess, such as 1:2 molar ratio, of the polyamine at a temperature higher than room temperature, preferably at a temperature higher than 100° C. In this reaction, an appropriate solvent, such as dimethylformamide or dimethylsulfoxide may be used to render the operation smooth. The use of a molar excess of the polyamine promotes the formation of a monoacylated derivative as the condensation product. The condensation reaction product can be used as such or the predominant ingredient, i.e., the monoacyl derivative can be separated by a suitable fractionation treatment, and used as the useful metal ion complexing agent of this invention. Examples of such useful monoacyl derivatives are those obtained by reacting the aforementioned fatty acids with the aforementioned polyamines. As preferably monoacyl derivatives can be enumerated N-octanoyl, ethylenediamine, N-octanoyl tetramethylenediamine, N-oxtanoyl pentamethylenediamine, N-octanoyl diethylenetriamine, N-decanoyl diethylenetriamine, N-dodecanoyl diethylenetriamine and N-(12-hydroxy-9-decenoyl)ethylenediamine. If necessary, the metal complexing agent may be used in the form of a salt, i.e., an amine salt, with an organic acid such as acetic acid or with an inorganic acid such as hydrochloric acid; such salts tend to exhibit higher water solubility than the free amine form with substantially the same complexing effect.

The metal ion capturing or complexing agent thus prepared possesses an extremely remarkable selective capturing action for metal ions, especially heavy metal ions, dissolved in water. When the pH value of solution containing metal ions is varied, a difference is produced in the bonding force of the complexing agent relative to the individual metals. By adjusting the pH value suitably, therefore, the complexing agent acts selectively on heavy metals, such as lead, copper, zinc, cadmium, mercury, iron, nickel, cobalt, manganese and chromium, whereby the individual metals can separately be removed. It is one of the significant characteristic properties of the complexing agent of this invention that when bound to metals it exhibits a very strong foaming force and is easily removable in the form of floating foams from the solution.

Each of the above metals has a characteristic pH range for the complexing of the ions thereof with the present complexing agents which is peculiar to that metal and appears in the following tabulation:

| | |
|---|---|
| cadmium ($Cd^{2+}$) | around 10 - around 12 |
| mercury ($Hg_2^{2+}$) | around 7 - around 12 |
| iron ($Fe^{2+}$) | around 7 - around 12 |
| chromium ($Cr^{3+}$) | around 8 - around 12 |
| copper ($Cn^{2+}$) | around 6 - around 12 |
| nickel ($Ni^{2+}$) | around 7 - around 12 |
| lead ($Pb^{2+}$) | around 8 - around 12 |
| cobalt ($Co^{2+}$) | around 9 - around 12 |
| zinc ($Zn^{2+}$) | around 9 - around 12 |
| manganese ($Mn^{2+}$) | around 10 - around 12 |

Ions of these metals can, therefore, be removed from solutions containing a single one of these metals by adjusting the solution pH to any point within its characteristic range. A more difficult case arises with solutions containing a combination of ions of two or more of such metals. As the above tabulation shows, the characteristic pH ranges for many of the listed metals have significantly different minimums or starting points, and where a given solution contains a mixture of ions of metals having differing characteristic pH ranges, the ions of one metal can be selectively removed to the exclusion of the ions of the remaining metals. This is accomplished by adjusting the solution pH to a level within the range of one metal but outside the range of the remaining metals, subjecting the solution to foaming conditions in the presence of the complexing agent, and removing the resultant foam which contains a complex of the agent and the particular metal. If the remaining metal ions likewise have differing pH ranges, the above steps can be repeated, the solution pH being re-adjusted to a new value within the range of the next metal but outside the range or ranges of the others.

The above treatment operations can be repeated as many times as the number of the kinds of metal ions present which have differing characteristic ranges. If there are present the ions of two kinds of metals having the same characteristic pH ranges, these ions can be separated together from ions of other metals which do have a different pH range but they cannot be individually removed by the process of this invention. Obviously, the stepwise pH adjustment is made from lower pH levels toward the higher pH levels since the differential occurs at the lower end of the ranges.

The recovery rates of the metal ions by the present process is surprisingly high and can approach 100% for a selected metal under optimum conditions, as where the characteristic range for the selected metal permits the selection of a solution pH reasonably well spaced from the ranges of other metals present. If the solution pH intrudes into the range of other metals present, some of the ions thereof may be complexed along with those of the selected metal.

The following examples are included merely to aid in the understanding of the invention and variations may be made by one skilled in the art without departing from the spirit and socpe of the invention. The relationships of the ion recovery rate vs. solution pH for the ions of each of these examples are depicted graphically in the FIGURES of the accompanying drawings which are numbered to correspond with the examples.

EXAMPLE 1

In a three-necked flask equipped with a cooling tube and a stirrer were placed diethylenetriamine and methyl decanoate in a molar ratio of 2:1. The mixture was reacted for 4 hours at 120° C. The reaction product was dissolved in chloroform and the solution was washed several times with water and dried over anhydrous sodium sulfate. Gaseous hydrogen chloride was allowed to pass through the solution to precipitate N-decanoyl diethylenetriamine dihydrochloride which was then collected by filtration with a recovery rate of 82%.

A glass tube proved with a cock at its lower end having an inner diameter of 3 cm and a length of 24 cm was used as an apparatus and a mixed aqueous solution of various metal salts (10 ppm as metal) was placed therein. N-decanoyl diethylenetriamine dihydrochloride dissolved in water was added to the solution and then the pH value of the mixture was adjusted with hydrochloric acid and an aqueous solution of sodium hydroxide. A bowl-type glass filter was dipped into the aqueous solution and air was passed therethrough for 10 minutes at a rate of 100 ml per minute by the aid of an air pump. The resulting foams were continuously sucked.

More precisely, an aqueous solution containing as metal salts, cupric sulfate (10 ppm as a copper) and zinc sulfate (10 ppm as zinc), was first prepared. N-decanoyl diethylenetriamine dihydrochloride was then dissolved in the aqueous solution to a concentration of 200 ppm. Under the condition thus controlled, N-decanoyl diethylenetriamine dihydrochloride selectively captured copper at a pH value of 5–10 and formed foams. On the other hand, N-decanoyl diethylenetriamine dihydrochloride substantially failed to capture zinc at a pH value of 5–8 but captured zinc only at a pH value of 9 or higher and formed foams. Thus, copper could selectively be captured at a recovery rate of 97% for 10 minutes by adjusting the pH value of the aqueous solution to 7, blowing air thereinto and collecting the resulting bubbles. In a similar manner, zinc could selectively be captured at a recovery rate of 98% by adjusting the pH value of the aqueous solution to 10, blowing air therein for 10 minutes and then collecting the resulting foams. The results of these tests are shown graphically in FIG. 1.

EXAMPLE 2

In a mixed aqueous solution of lead acetate (10 ppm as lead) and zinc sulfate (10 ppm as zinc), N-decanoyl diethylenetriamine dihydrochloride of Example 1 as the selective metal capturing agent was dissolved until its concentration became 200 ppm. When the pH value of the mixed solution was adjusted to 8, the amidoamine hydrochloride selectively captured lead and showed strong foaming property. Air was blown into the solution for 10 minutes and the resulting foams were collected whereby lead alone was recovered at a recovery rate of 90%. When the pH value of the mixed solution was adjusted to 10 in a similar manner, N-decanoyl diethylenetriamine dihydrochloride selectively captured zinc alone and showed foaming property. Air was blown into the solution for 10 minutes and the resulting foams were collected whereby zinc was recovered at a recovery rate of 98%. The results of these tests are shown graphically in FIG. 2.

EXAMPLE 3

In a manner similar to that described in Example 1, methyl-12-hydroxy-9-oxtadecenoate was reacted with ethylenediamine and N-(12-hydroxy-9-octacenoyl)ethylenediamine hydrochloride was recovered at a rate of 80%.

N-(12-hydroxy-9-octadeconyl)ethylenediamine hydrochloride thus obtained was then dissolved in a mixed aqueous solution of cupric sulfate (10 ppm as copper) and zinc sulfate (10 ppm as zinc) to give a concentration of N-(12-hydroxy-9-octadecenoyl) ethylenediamine hydrochloride of 250 ppm. After adjusting the pH value of the solution to 7, air was blown therein and the resulting foams were collected whereby copper alone was selectively recovered at a recovery rate of 60%. In a similar manner, zinc could be recovered at a recovery rate of 70% by adjusting the pH value of the mixed solution to 10, blowing air therein and collecting the resulting foams. The results of these tests are shown graphically in FIG. 3.

EXAMPLE 4

N-decanoyl diethylenetriamine dihydrochloride obtained in the same manner as described in Example 1 was dissolved in a mixed aqueous solution of calcium sulfate (500 ppm as calcium), cupric sulfate (10 ppm as copper), zinc sulfate (10 ppm as zinc) and lead acetate (10 ppm as lead) to give a concentration of N-decanoyl diethylenetriamine dihydrochloride of 200 ppm. Copper could selectively be recovered at a recovery rate of 97% by adjusting the pH value of the mixed solution to 7, blowing air therein and collecting the resulting foams. When the pH value of the solution was adjusted to 8 and the operation was conducted similarly, lead alone could be recovered selectively at a recovery rate of 90%. Next, the pH value of the solution was adjusted to 10 and the operation was conducted in a similar manner whereby zinc could selectively be recovered at a recovery rate of 98%. Calcium ions do not complex with the agents of the invention but remain in the solution and can be recovered as residue after the metallic ions have been removed. The results of these tests are shown graphically in FIG. 4.

EXAMPLE 5

N-decanoyl diethylenetriamine dihydrochloride obtained in the same manner described in Example 1 was used as capturing agent for metal ions of copper, nickel, lead, cobalt and manganese. Each metal ion was selectively captured as follows:

A mixed aqueous solution of cupric sulfate (10 ppm as copper), nickel sulfate (10 ppm as nickel), lead nitrate (10 ppm as lead), cobalt sulfate (10 ppm as cobalt) and manganese sulfate (10 ppm as manganese was charged into a glass tube provided with a petcock at its lower end, the tube having an inner diameter of 3 cm and a length of 24 cm, and then N-decanoyl diethylenetriamine dihydrochloride was added therein to give a concentration of N-decanoyl diethylenetriamine dihydrochloride of 240 ppm.

Then, the pH value of the mixture was adjusted to 6 with hydrochloric acid. A bowl-type glass filter was dipped into the aqeous solution and air was passed therethrough for 10 minutes at a rate of 100 ml per minute by the aid of an air pump. The resulting foams were continuously sucked out from the solution. Copper could selectively be recovered at a recovery rate of about 100%.

Subsequently, the pH value of the residual solution was adjusted to 7 with an aqueous solution of sodium hydroxide and the solution was treated in a similar manner as above. Lead was recovered at a recovery rate of about 70%.

The pH value of the residual solution was adjusted to 9 with an aqueous solution of sodium hydroxide and the solution was treated in a similar manner as above. Cobalt was recovered at a recovery yield of about 60%.

Finally, the pH value of the residual solution was adjusted to 10 with an aqueous solution of sodium hydroxide and the solution was treated in a similar manner as above. Manganese was recovered at a recovery yield of about 80%. The results of these tests are shown graphically in FIG. 6.

EXAMPLE 6

In a manner similar to that described in Example 1, methyl-dodecanoate was reacted with diethylenetriamine, producing 81% of the condensate product. Thus obtained N-dodecanoyl diethylenetriamine dihydrochloride was dissolved in a mixed aqueous solution of copper sulfate (10 ppm as copper), nickel sulfate (10 ppm as nickel), and manganese sulfate (10 ppm as manganese) to give a concentration of N-dodecanoyl diethylenetriamine dihydrochloride of 183 ppm.

The pH value of the solution was adjusted to 6 with hydrochloric acid, the air being blown into the solution and the resulting foams being sucked out from the solution. Copper could be selectively recovered at a recovery yield of about 100%.

Subsequently, the pH value of the residual solution was adjusted to 7 with an aqueous solution of sodium hydroxide, the air being blown into the solution and the resulting foams being sucked out from the solution. Nickel could be selectively recovered at a recovery yield of about 90%.

Finally, the pH value of the residual solution was adjusted to 10 with an aqueous solution of sodium hydroxide, the air being blown into the solution and the resulting foams being sucked out from the solution. Manganese could be selectively recovered at a recovery yield of about 100%. The results of these tests are shown graphically in FIG. 5.

EXAMPLE 7

Example 1 was repeated using a solution containing zinc and manganese ions, adjusting the pH thereof to about pH9, and blowing air therein to form foams which were removed, the ion recovery rate was 25.4% for manganese and 90.3% for zinc. The results of these tests are shown graphically in FIG. 7.

What is claimed is:

1. The method of eliminating at least one kind of metal ions selected from the group consisting of the following metals having the respective characteristic complexing pH ranges

| | |
|---|---|
| cadmium ($Cd^{2+}$) | around 10 - around 12 |
| mercury ($Hg_2^{2+}$) | around 7 - around 12 |
| iron ($Fe^{2+}$) | around 7 - around 12 |
| chromium ($Cr^{3+}$) | around 8 - around 12 |
| copper ($Cu^{2+}$) | around 6 - around 12 |
| nickel ($Ni^{2+}$) | around 7 - around 12 |
| lead ($Pb^{2+}$) | around 8 - around 12 |
| cobalt ($Co^{2+}$) | around 9 - around 12 |
| zinc ($Zn^{2+}$) | around 10 - around 12 |
| manganese ($Mn^{2+}$) | around 10 - around 12 |

from a solution containing at least said one kind of metal ions in solution by the steps comprising complexing said ions by adding to said solution an effective amount for complexing with said metal ions of a condensation product of a fatty acid having at least about 8 carbon atoms or an ester or halide thereof with an excess molar amount of a polyamine having the general formula:

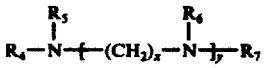

where $R_{4-7}$ each represent a hydrogen atom or a hydrophobic group selected from an alkyl group, and an arylalkyl group, and $x$ is an integer from 1 to 5 and $y$ is an integer from 1 to 4, adjusting the pH of the resultant complex-containing solution to a value within the above-specified characteristic range for the kind of metal ions to be separated, subjecting the pH adjusted solution containing said complex to foaming conditions, and separating from the solution the resultant foam containing the complex of said ions and said condensation product.

2. The method of claim 1 wherein $R_{4-7}$ are each a hydrogen atom.

3. The method of claim 1 for selectively removing the ions of at least one metal having a given characteristic pH range from a solution containing in solution a mixture of such ions with other ions of at least one other metal having a characteristic pH range having a threshold value which is significantly different from that of the range of said one metal wherein said solution pH is adjusted to a level above the threshold of the characteristic range for the ions to be removed but below the threshold of the characteristic range of the other ions whereby complexing occurs selectively between said agent and the ions of such first metal.

4. The method of claim 3 wherein after removal of the ions of such first metal, the content of said condensation product is adjusted as necessary to provide an effective amount for complexing with the ions of the other metal, said solution pH is readjusted to a value above the threshold of the characteristic range for such other metal, said solution is again subjected to foaming conditions, and the resultant foam contaning such other metal ions is removed.

* * * * *